US009889365B2

(12) United States Patent
Gravel et al.

(10) Patent No.: US 9,889,365 B2
(45) Date of Patent: Feb. 13, 2018

(54) AUXILIARY ROLLER ASSEMBLY FOR A SPORTS GOAL

(71) Applicants: James H. Gravel, The Villages, FL (US); James Ritchie, Jr., Brewster, MA (US)

(72) Inventors: James H. Gravel, The Villages, FL (US); James Ritchie, Jr., Brewster, MA (US)

( * ) Notice: Subject to any disclaimer, the term of this patent is extended or adjusted under 35 U.S.C. 154(b) by 49 days.

(21) Appl. No.: 14/795,047

(22) Filed: Jul. 9, 2015

(65) Prior Publication Data

US 2016/0023084 A1 Jan. 28, 2016

Related U.S. Application Data

(60) Provisional application No. 62/022,242, filed on Jul. 9, 2014.

(51) Int. Cl.

| | |
|---|---|
| ***A63B 71/00*** | (2006.01) |
| ***A63B 63/00*** | (2006.01) |
| ***A63B 71/02*** | (2006.01) |

(52) U.S. Cl.

CPC ..... *A63B 71/0036* (2013.01); *A63B 63/004* (2013.01); *A63B 2071/025* (2013.01); *A63B 2071/026* (2013.01)

(58) Field of Classification Search

CPC ..... A63B 71/0036; A63B 63/004; A63B 71/0054

See application file for complete search history.

(56) References Cited

U.S. PATENT DOCUMENTS

| | | | | |
|---|---|---|---|---|
| 4,389,047 A * | 6/1983 | Hall | A63B 19/04 482/2 |
| 8,905,872 B2 * | 12/2014 | Ennis | A63B 63/004 273/400 |
| 2014/0169922 A1 * | 6/2014 | Cozza | B62B 3/0625 414/495 |

* cited by examiner

*Primary Examiner* — Gene Kim
*Assistant Examiner* — Jeffrey Vanderveen
(74) *Attorney, Agent, or Firm* — John M Brandt

(57) ABSTRACT

An auxiliary weighted roller assembly attachable to a sports goal ground crossbar to stabilize the goal and to facilitate temporary or long term relocation for field maintenance, alternative field use, or storage consisting of a framework attachable to the crossbar and a pair of weighted rollers attached to the framework one each disposed on the front and rear of the crossbar and of sufficient diameter to raise the crossbar above the ground.

10 Claims, 8 Drawing Sheets

AUXILIARY ROLLER ASSEMBLY FOR A SPORTS GOAL

CROSS REFERENCE TO RELATED APPLICATIONS

This application is based on the disclosure of U.S. provisional patent application 62/022,242 by the same inventors filed Jul. 9, 2014 which is hereby incorporated by reference.

BACKGROUND OF THE INVENTION

1. Field of the Invention

The invention resides in field of sports goals and more particularly relates to goals for outdoor use having a framework for supporting a net and further to devices pertaining to preventing such goals from tipping over or shifting position due to high wind, player impact, or inappropriate use by unauthorized use by others.

2. Description of the Prior Art

There is great concern for the stability of sports goals for use on outdoor playing fields for sports such as soccer, field hockey, and the like, and the prevention of injury from accidental or inappropriate use of such goals particularly as they are often unattended due to their public locations. At the same time, it is necessary to occasionally move such goals for field maintenance, long term storage, or alternative field use.

A number of solutions have been proposed including stakes, augers, and portable sandbags as weights all of which are easily tampered with when the goals are unsupervised. A weighted ground crossbar mounted roller system is disclosed in U.S. Pat. No. 8,579,736, Gravel, which, while addressing the problems of stability and mobility is not easily incorporated into existing goals having a wide variety of ground crossbars as are being currently or previously manufactured. The present invention presents a system which is capable of being attached to wide variety of goals for the above stated purposes and is easy to install but not remove or misplace as are most of the prior art devices known to the inventors.

SUMMARY OF THE INVENTION

The invention may be summarized as an auxiliary roller apparatus for a sports goal attachable to a rear ground crossbar disposed between two spaced apart side structures arranged to support a net for trapping a game ball or puck, the apparatus consisting of a frame assembly arranged to position and secure a pair of weighted rollers, one forward of, one rearward of, and substantially parallel to the ground crossbar.

The apparatus functions to provide a substantial counter weight to any forces which may result in the goal shifting or tipping such as strong winds, player contact, or inappropriate use by one or more individuals, for example, hanging from a front or side component of the structure.

The apparatus is designed to allow the goal to be easily moved for temporary or long term relocation for field maintenance, alternative field use, or off season storage. It is optionally configured to be attachable to a standard range of sizes and shapes of cross bars, round, square, and oval, without altering the cross bars; to allow lifting the front of the goal for repositioning without lifting the weight of the forward roller; and further to provide a latitude of stearability during repositioning to maneuver the goal into positions difficult to reach. A recessed port disposed on the longitudinal surface of the rollers for filling the rollers with ballast, sand for example, is also disclosed.

These and other features and advantages of the invention will become clearer from the description of the preferred embodiments taken with the drawings which follows.

DESCRIPTION OF THE PREFERRED EMBODIMENTS

Figure 1:
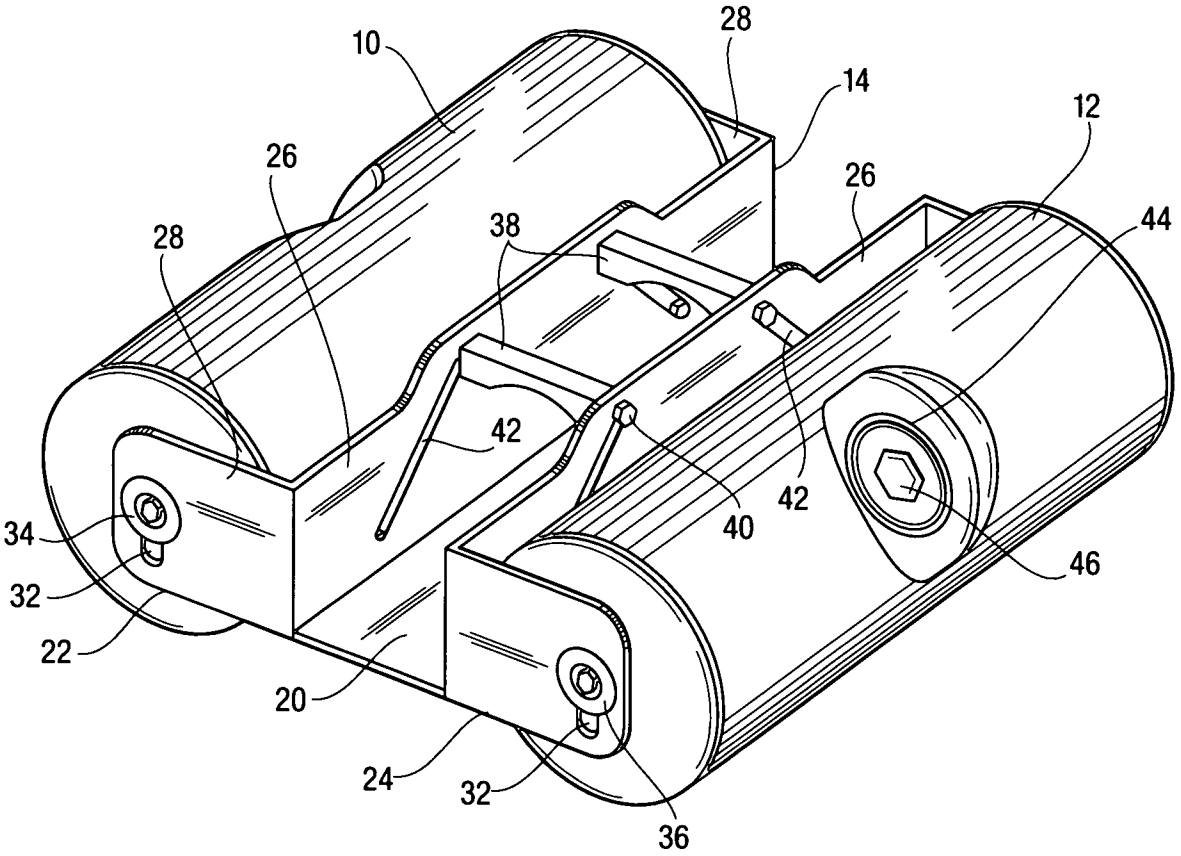
FIG. 1 is a perspective view of the preferred embodiment of the invention.
Figure 2:
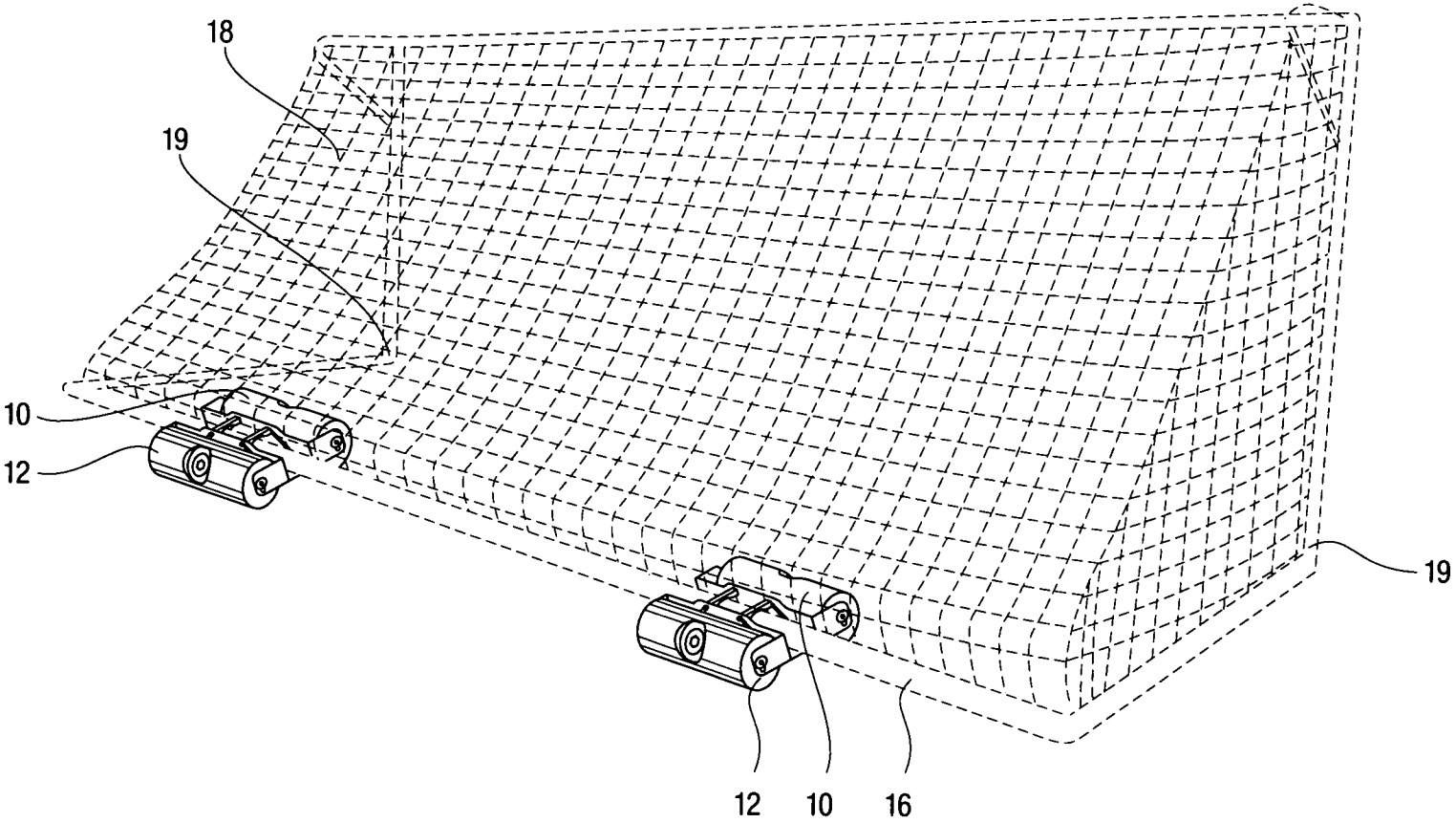
FIG. 2 is a perspective view of the embodiment of FIG. 1 installed on a sports goal.

Referring first to FIG. 1, a perspective view of the preferred embodiment is illustrated in which front hollow roller 10 and rear hollow roller 12 are mounted on frame 14. The assembly as shown is symmetrical allowing for a reverse or 180 degree rotation in positioning the apparatus on a rear ground crossbar 16 of a goal 18 which mounting is shown in FIG. 2.

Figure 5:
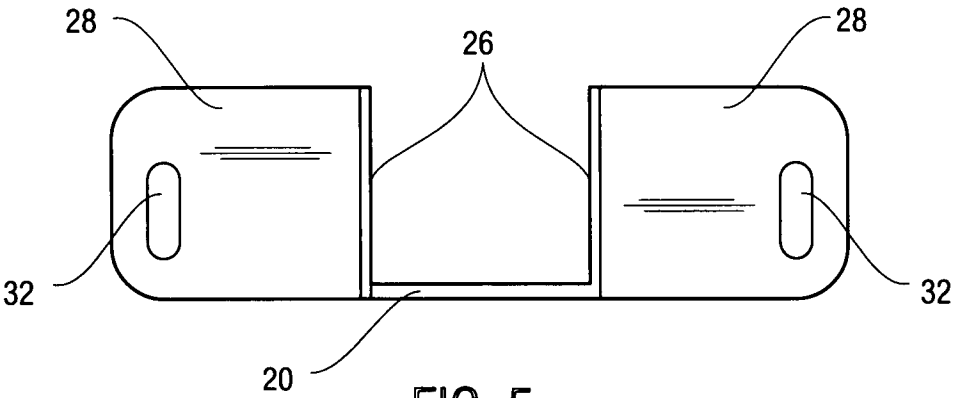
FIG. 5 is a side view of the element of FIG. 4.
Figure 6:
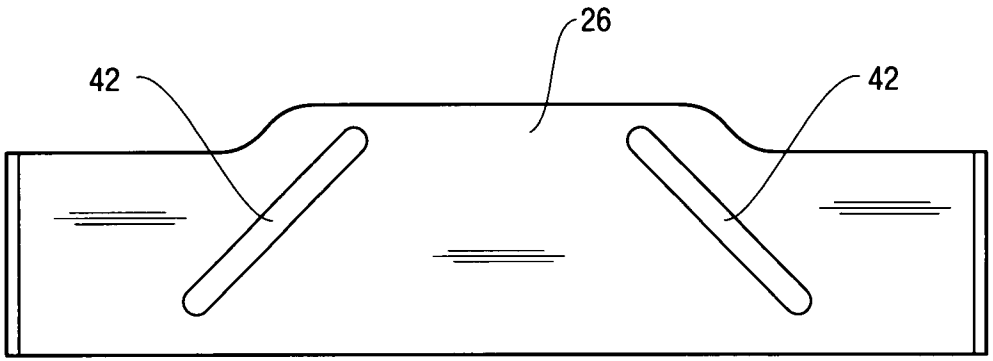
FIG. 6 is a rear view of the element of FIG. 4.

Frame 14 consists of a central bottom plate 20 joining two spaced apart front and rear roller mounting brackets 22 and 24. As further shown in FIGS. 4-6, each bracket is composed of a vertical longitudinal upright 26 and a pair of two side uprights 28 disposed one each at opposite ends of upright 26.

Figure 3:
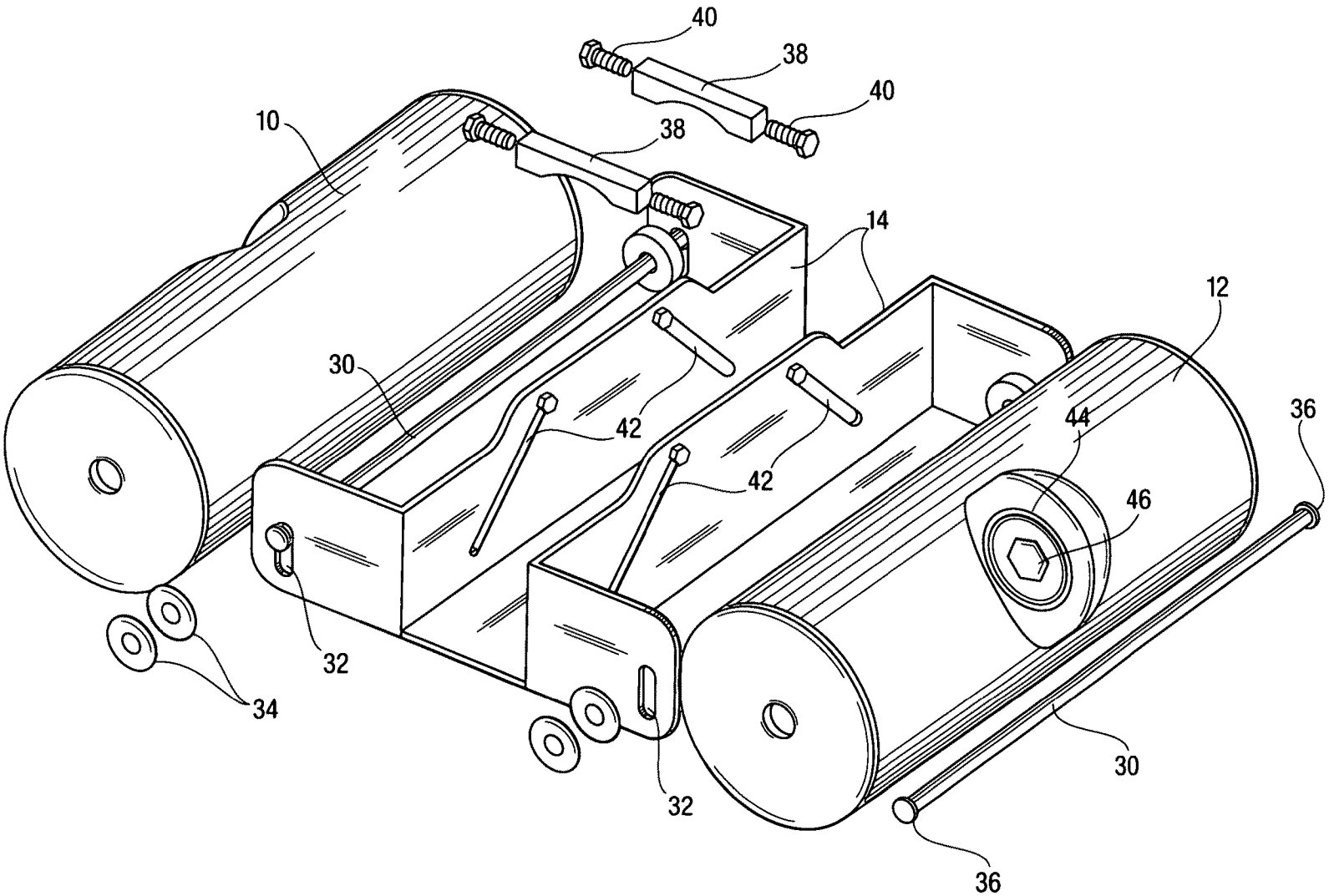
FIG. 3 is an exploded view of the embodiment of FIG. 1.

Each pair of uprights 28 provides a mounting support for a roller axel 30 longitudinally disposed substantially parallel to upright 26 as further illustrated in the exploded view of FIG. 3. Each axel 30 is slideably mounted between a matching pair of side uprights 28 in substantially vertical slots 32 disposed therein and secured thereto by a suitable combination of inside and outside washers 34 on each side of uprights 28 and a ROTORCLIP TX-50 shaft ring 36 or similar device connected to each end of the axel.

Each roller is therefore, with respect to the ground crossbar, free to rotate about a parallel longitudinal axis to that of the crossbar and further to move up and down vertically within the confines of the upper and lower ends of slots 32. This provides the benefit of the front 19 of the goal to be raised a slight amount above the ground to facilitate a moving operation with out raising either of the rollers and their commensurate weight off the ground as well.

Figure 7:
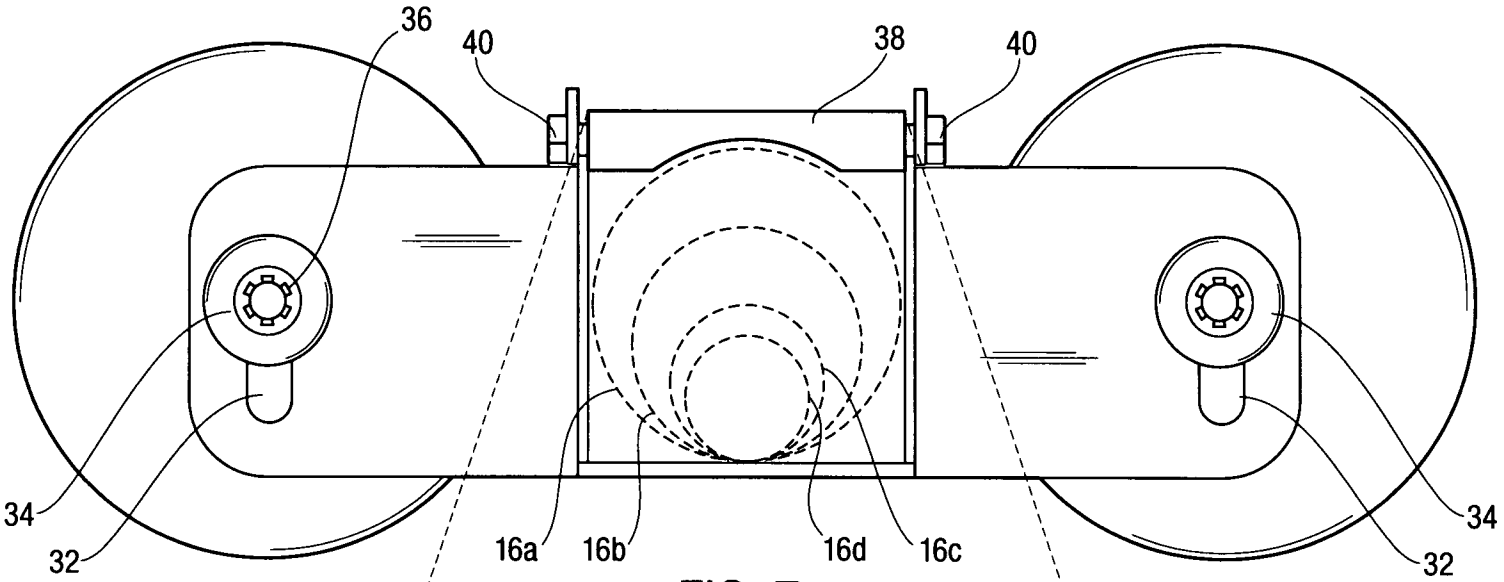
FIG. 7 is a side view of the embodiment of FIG. 1 illustrating alternative installation options of the invention.
Figure 8:
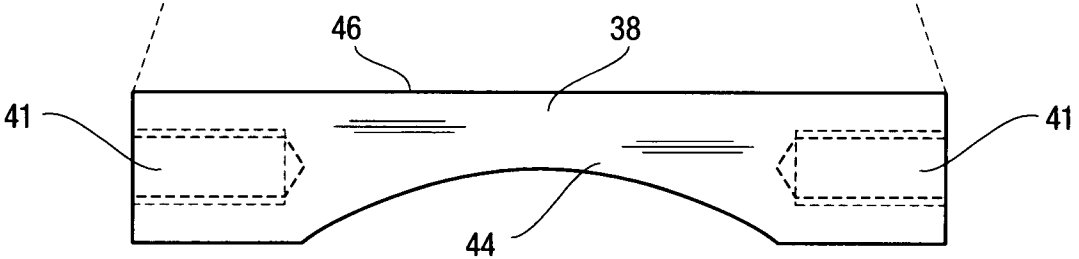
FIG. 8 is a side cross-sectional view of an additional element of the embodiment of FIG. 1.

Bottom plate 20 and the front and rear vertical longitudinal uprights 26 comprise in combination a cradle for receiving ground crossbar 16 as shown in FIGS. 2 and 7. As is illustrated, the assemblies are best employed in spaced apart pairs, one near each side of the goal.

Figure 4:
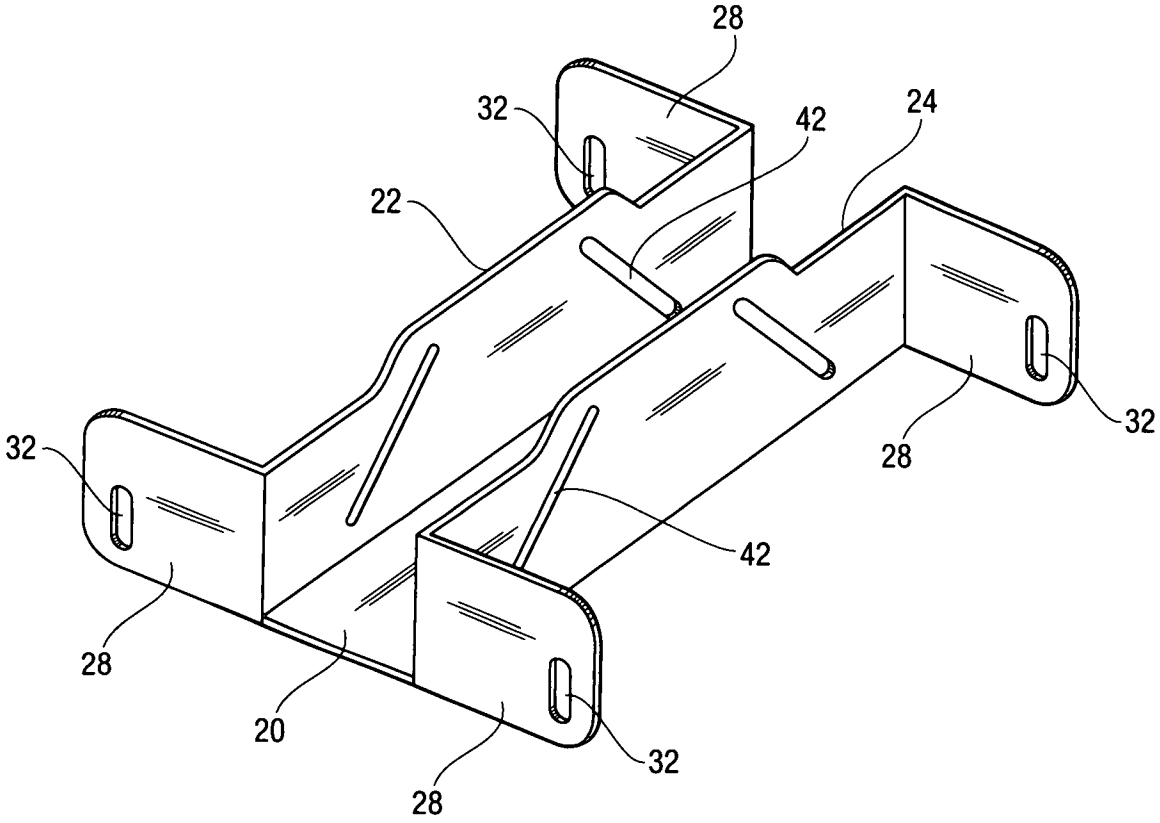
FIG. 4 is a perspective view of one element of the embodiment of FIG. 1.

The crossbar is secured in the cradle by downward clamping pressure provided by a pair of longitudinally opposed clamping members 38 secured by side bolts 40. Slots 42 disposed in uprights 26 provide in combination a set of tracks for bolts 40 which when loose allow clamping member 38 to move up and down into various positions. Clamping members 38 have a curved side 44 and a flat side 46 which, upon rotation, provide appropriate contact with either a flat ground crossbar, or a round or oval crossbar of varying size (16*a*-16*d* as shown in FIG. 4) up to the width of bottom plate 20. When a clamping member 38 is secured firmly in place by bolts 40 atop a ground crossbar resting on bottom plate 20, the entire assembly of frame 14 and rollers 10 and 12 is secured to the goal.

Hollow rollers 10 and 12 require ballast in order to sufficiently weigh down the goal and such may be provided by sand, for example, deposited to the interior of both rollers through ports 44 disposed in the curved surface of the roller and closed by threaded caps 46.

Figure 9:
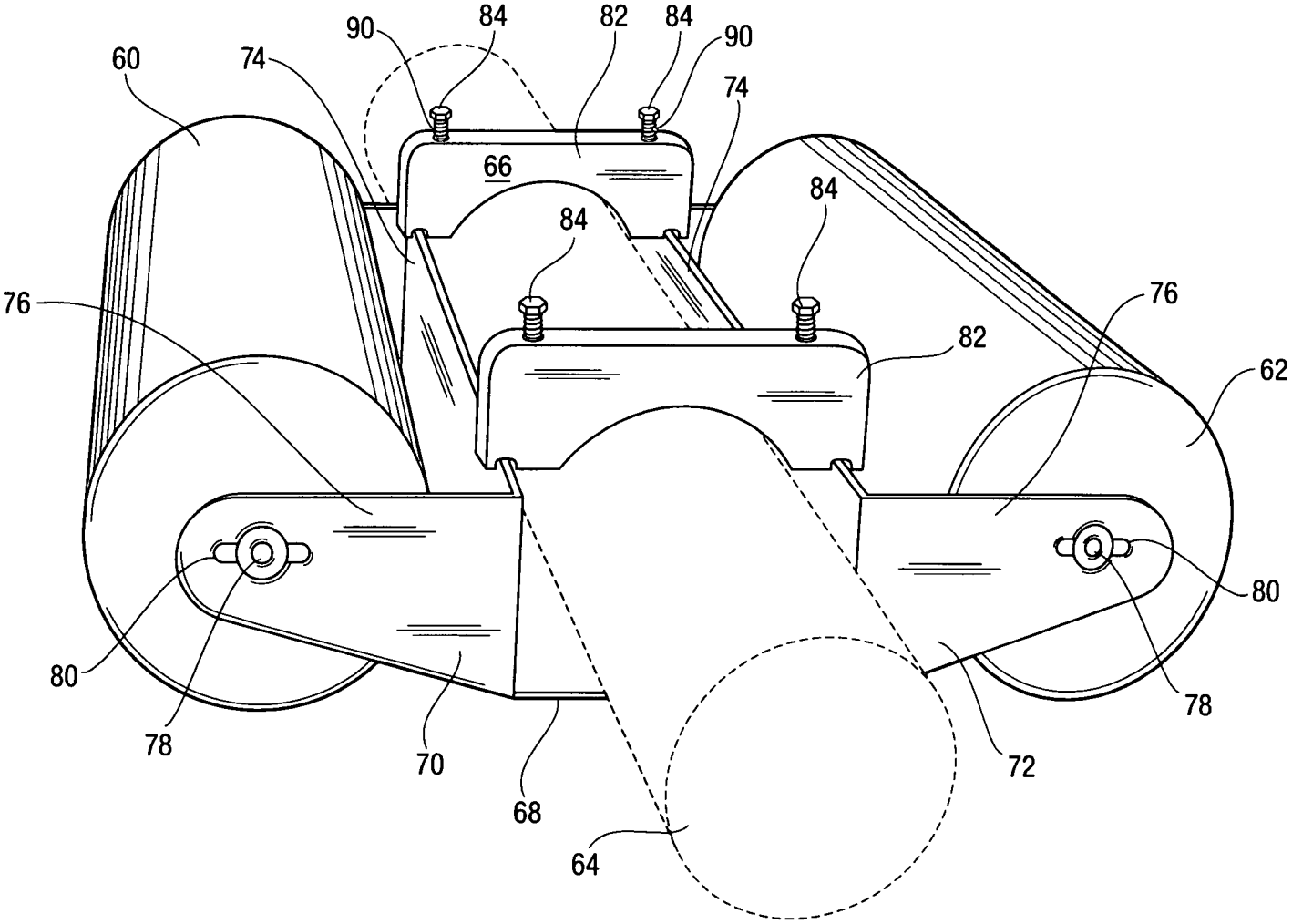
FIG. 9 is a perspective view of an additional embodiment of the invention.
Figure 10:
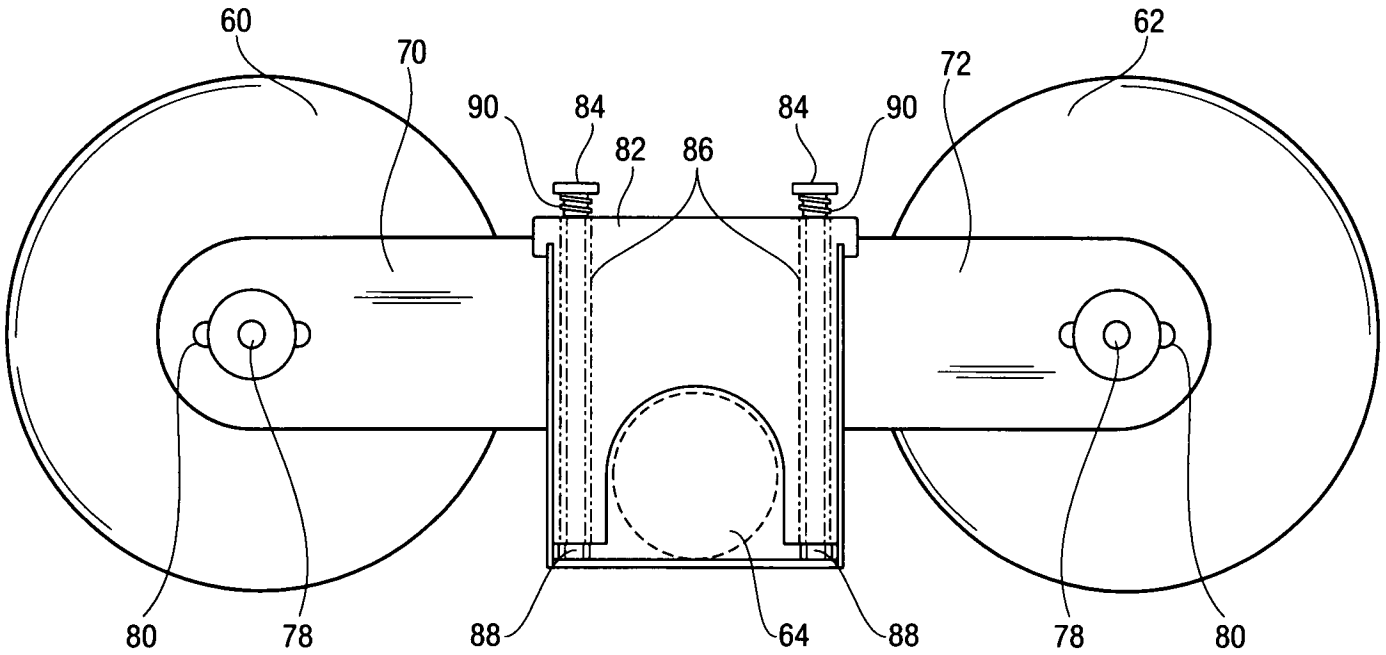
FIG. 10 is a side view of the embodiment of FIG. 1.

Referring next to FIGS. 9 and 10, an additional embodiment of the roller assembly described above is shown in which rollers 60 and 62 are attached to a goal rear ground crossbar 64 employing frame 66 consisting of a central bottom plate 68 joining two spaced apart front and rear roller mounting brackets 70 and 72. Each bracket is composed of a vertical longitudinal upright 74 and a pair of two side uprights 76 disposed one each at opposite ends of upright 74.

Each pair of uprights 76 provides a mounting support for a roller axel 78 longitudinally disposed substantially parallel to upright 74. Each axel 78 is slideably mounted between a matching pair of side uprights 76 in substantially horizontal slots 80 disposed therein and secured thereto by, for example, a combination of washers and a ROTORCLIP TX-50 shaft ring or similar device connected to each end of the axel as described above. Mounting of the axels in these horizontal slots will allow the rollers to swivel a limited amount when the goal is being repositioned imparting a degree of stearability to maneuver in tight spaces.

Further illustrated is an alternative means to attach the framework and rollers to ground rear crossbar 64 consisting of hold down brackets 82 positioned over crossbar 64 and secured in place by hexbolts 84 disposed in bolt housings or channels 86 in bracket 82 communicating with threads in bottom plate 68 or a nut 88 underneath or attached thereto. The bottom surface of bracket 82 may be shaped and size in any appropriate profile suitable for the goal crossbar to which the assembly is to be attached.

Coil springs 90 may be disposed between the bolt head and the top bracket surface to act as a piston and allow the brackets to partially release from the crossbar to rotate when the goal is lifted to facilitate relocation.

Variations in the above described preferred embodiments may be made within the general concept of the disclosure. The invention is therefore accordingly defined by the following claims.

What is claimed is:

1. A weighted roller apparatus for a ground disposed sports goal, said goal comprising a net supporting frame having at least two spaced apart side members joined at the rear by a nonrotatable ground crossbar, said ground crossbar having a length substantially greater than diameter, and at the front by a top crossbar, said roller apparatus comprising in combination:

A. a framework attachable to said ground crossbar, said ground crossbar having a longitudinal axis;

B. a first weighted roller having a longitudinal axis and an outer surface, said roller rotatably attached to said framework forward of and spaced apart from said ground crossbar, the longitudinal axis of said first weighted roller arranged to be substantially parallel to that of said ground crossbar;

C. a second weighted roller having a longitudinal axis and an outer surface, said roller rotatably attached to said framework rearward of and spaced apart from said ground crossbar, the longitudinal axis of said second weighted roller arranged to be substantially parallel to that of said ground crossbar and said first weighted roller, the diameters of said outer surfaces of said first and second weighted rollers of sufficient size to raise said framework and said ground crossbar above said ground;

wherein each of said rollers is rotationally mounted on an axel attached to said framework; and D. wherein said framework comprises:

1. a bottom plate arranged to support said ground crossbar;
2. a first weighted roller mounting bracket attached to said bottom plate and disposed forward of said ground crossbar; and
3. a second weighted roller mounting bracket attached to said bottom plate and disposed rearward of said ground crossbar; and E. wherein at least one of said mounting brackets comprises:

1. an upright member longitudinally attached to said bottom plate; and
2. a pair of side members disposed one at each end of and extending outwardly from said bottom plate and said crossbar, said side members arranged to support said axle and said roller; and F. wherein each of said side members has a substantially vertical slot disposed therein, said slots are longitudinally aligned with said crossbar and each other, said slots are arranged to receive said axle, and wherein said axle is vertically slideably mounted within said slots between said side members.

2. A weighted roller apparatus for a ground disposed sports goal, said goal comprising a net supporting frame having at least two spaced apart side members joined at the rear by a nonrotatable ground crossbar, said ground crossbar having a length substantially greater than diameter, and at the front by a top crossbar, said roller apparatus comprising in combination:

A. a framework attachable to said ground crossbar, said ground crossbar having a longitudinal axis;

B. a first weighted roller having a longitudinal axis and an outer surface, said roller rotatably attached to said framework forward of and spaced apart from said ground crossbar, the longitudinal axis of said first weighted roller arranged to be substantially parallel to that of said ground crossbar;

C. a second weighted roller having a longitudinal axis and an outer surface, said roller rotatably attached to said framework rearward of and spaced apart from said ground crossbar, the longitudinal axis of said second weighted roller arranged to be substantially parallel to that of said ground crossbar and said first weighted roller, the diameters of said outer surfaces of said first and second weighted rollers of sufficient size to raise said framework and said ground crossbar above said ground;

wherein each of said rollers is rotationally mounted on an axel attached to said framework; and D. wherein said framework comprises:

1. a bottom plate arranged to support said ground crossbar;

2. a first weighted roller mounting bracket attached to said bottom plate and disposed forward of said ground crossbar; and
3. a second weighted roller mounting bracket attached to said bottom plate and disposed rearward of said ground crossbar; and E. wherein at least one of said mounting brackets comprises:
1. an upright member longitudinally attached to said bottom plate; and
2. a pair of side members disposed one at each end of and extending outwardly from said bottom plate and said crossbar, said side members arranged to support said axle and said roller;

F. wherein said framework is further composed of two of said brackets, one arranged to be disposed forward of said crossbar, the other arranged to be disposed rearward of said crossbar, said brackets and said bottom plate forming a cradle for receiving said crossbar; and G. clamping means for securing said crossbar to said bottom plate.

3. The weighted roller apparatus of claim 2 wherein said clamping means comprises:

A. a pair of longitudinally opposed spaced apart clamping members perpendicularly and vertically slideably disposed between said upright members, said clamping members having an upper edge and a lower edge, said lower edge having a curved indented segment having a periphery at least as great as that of said crossbar to be disposed therein; and B. securing means for securing said clamping members at a selected vertical height above said bottom plate wherein the upper surface of said crossbar is in contact with said curved indented segment, whereby a clamping force is applied between said crossbar and said weighted roller apparatus to secure said apparatus to said crossbar at a selected longitudinal position along said crossbar.

4. The weighted roller apparatus of claim 3 wherein said clamping members comprise;

A. at least two longitudinal bars in spaced apart relationship each having a first end disposed forward of said crossbar and a second end disposed rearward of said crossbar, each of said ends has a threaded port longitudinally disposed therein, and wherein each of said uptight members has a slot diagonally disposed therein, said slot extending from an upper portion to a lower portion of said upright member, said threaded ports arranged to align with said slots for each of said bars; and B. a plurality of threaded bolts, one each disposed through one of said slots and arranged to engage one of said threaded ports whereby upon positioning said bars in contact with said crossbar and upon tightening said bolts within said ports, said weighted roller apparatus will be secured to said crossbar.

5. The weighted roller apparatus of claim 3 wherein said clamping members comprise;

A. at least two hold down brackets in spaced apart relationship, each having an upper edge and a lower edge, each having a first side portion disposed forward of said crossbar and a second side portion disposed rearward of said crossbar, each of said side portions having a bolt receiving port vertically disposed therein, each of said ports extending from said upper edges to said lower edges of said hold down brackets;

B. a plurality of threaded receptacles positioned on said bottom plate, one each aligned with one each of said bolt receiving ports; and C. a plurality of bolts, one each disposed in one of said bolt receiving ports and arranged to engage one of said threaded receptacles whereby upon positioning said hold down brackets in contact with said crossbar and upon tightening said bolts within said receptacles, said weighted roller apparatus will be secured to said crossbar.

6. The weighted roller apparatus of claim 2 wherein said clamping means comprises:

A. a pair of longitudinally opposed spaced apart clamping members perpendicularly and vertically slideably disposed between said upright members, said clamping members having an upper edge and a lower edge, said lower edge having a curved indented segment having a periphery at least as great as that of said crossbar to be disposed therein; and B. securing means for securing said clamping members at a selected vertical height above said bottom plate wherein the upper surface of said crossbar is in contact with said curved indented segment, whereby a clamping force is applied between said crossbar and said weighted roller apparatus to secure said apparatus to said crossbar at a selected longitudinal position along said crossbar.

7. The weighted roller apparatus of claim 6 wherein said clamping members comprise;

A. at least two longitudinal bars in spaced apart relationship each having a first end disposed forward of said crossbar and a second end disposed rearward of said crossbar, each of said ends has a threaded port longitudinally disposed therein, and wherein each of said upright members has a slot diagonally disposed therein, said slot extending from an upper portion to a lower portion of said upright member, said threaded ports arranged to align with said slots for each of said bars; and B. a plurality of threaded bolts, one each disposed through one of said slots and arranged to engage one of said threaded ports whereby upon positioning said bars in contact with said crossbar and upon tightening said bolts within said ports, said weighted roller apparatus will be secured to said crossbar.

8. The weighted roller apparatus of claim 6 wherein said clamping members comprise;

A. at least two hold down brackets in spaced apart relationship, each having an upper edge and a lower edge, each having a first side portion disposed forward of said crossbar and a second side portion disposed rearward of said crossbar, each of said side portions having a bolt receiving port vertically disposed therein, each of said ports extending from said upper edges to said lower edges of said hold down brackets;

B. a plurality of threaded receptacles positioned on said bottom plate, one each aligned with one each of said bolt receiving ports; and C. a plurality of bolts, one each disposed in one of said bolt receiving ports and arranged to engage one of said threaded receptacles whereby upon positioning said hold down brackets in contact with said crossbar and upon tightening said bolts within said receptacles, said weighted roller apparatus will be secured to said crossbar.

9. The combination of a ground disposed sports goal and a weighted roller apparatus, said combination comprising:

A. a ground disposed sports goal comprising:

a net supporting frame comprising:

1. at least two spaced apart side members;
2. a nonrotatable ground crossbar joining said side members at the rear of said goal, said ground crossbar having a length substantially greater than diameter, and
3. a top crossbar joining said side members at the front of said goal; and B. a weighted roller apparatus comprising in combination:

1. a framework attached to said ground crossbar, said ground crossbar having a longitudinal axis;
2. a first weighted roller having a longitudinal axis and an outer surface, said roller rotatably attached to said framework forward of and spaced apart from said ground crossbar, the longitudinal axis of said first weighted roller arranged to be substantially parallel to that of said ground crossbar,
3. a second weighted roller having a longitudinal axis and an outer surface, said roller rotatably attached to said framework rearward of and spaced apart from said ground crossbar, the longitudinal axis of said second weighted roller arranged to be substantially parallel to that of said ground crossbar and said first weighted roller, the diameters of said outer surfaces of said first and second weighted rollers of sufficient size to raise said framework and said ground crossbar above said ground;

wherein each of said rollers is rotationally mounted on an axel attached to said framework; and 4. wherein said framework comprises:
   a. a bottom plate arranged to support said ground crossbar;
   b. a first weighted roller mounting bracket attached to said bottom plate and disposed forward of said ground crossbar; and
   c. a second weighted roller mounting bracket attached to said bottom plate and disposed rearward of said ground crossbar; and
5. wherein at least one of said mounting brackets comprises:
   a. an upright member longitudinally attached to said bottom plate; and
   b. a pair of side members disposed one at each end of and extending outwardly from said bottom plate and said crossbar, said side members arranged to support said axle and said roller; and
6. wherein each of said side members has a substantially vertical slot disposed therein, said slots are longitudinally aligned with said crossbar and each other, said slots are arranged to receive said axle, and wherein said axle is vertically slideably mounted within said slots between said side members.

10. The combination of a ground disposed sports goal and a weighted roller apparatus, said combination comprising:

A. a ground disposed sports goal comprising:

a net supporting frame comprising:

1. at least two spaced apart side members;
2. a nonrotatable ground crossbar joining said side members at the rear of said goal, said ground crossbar having a length substantially greater than diameter, and
3. a top crossbar joining said side members at the front of said goal; and B. a weighted roller apparatus comprising in combination:

1. a framework attached to said ground crossbar, said ground crossbar having a longitudinal axis;
2. a first weighted roller having a longitudinal axis and an outer surface, said roller rotatably attached to said framework forward of and spaced apart from said ground crossbar, the longitudinal axis of said first weighted roller arranged to be substantially parallel to that of said ground crossbar;
3. a second weighted roller having a longitudinal axis and an outer surface, said roller rotatably attached to said framework rearward of and spaced apart from said ground crossbar, the longitudinal axis of said second weighted roller arranged to be substantially parallel to that of said ground crossbar and said first weighted roller, the diameters of said outer surfaces of said first and second weighted rollers of sufficient size to raise said framework and said ground crossbar above said ground;

wherein each of said rollers is rotationally mounted on an axel attached to said framework; and 4. wherein said framework comprises:
   a. a bottom plate arranged to support said ground crossbar;
   b. a first weighted roller mounting bracket attached to said bottom plate and disposed forward of said ground crossbar; and
   c. a second weighted roller mounting bracket attached to said bottom plate and disposed rearward of said grouncrossbar; and
5. wherein at least one of said mounting brackets comprises:
   a. an upright member longitudinally attached to said bottom plate; and
   b. a pair of side members disposed one at each end of and extending outwardly from said bottom plate and said crossbar, said side members arranged to support said axle and said roller;
6. wherein said framework is further composed of two of said brackets, one arranged to be disposed forward of said crossbar, the other arranged to be disposed rearward of said crossbar, said brackets and said bottom plate forming a cradle for receiving said crossbar; and
7. clamping means for securing said crossbar to said bottom plate.

* * * * *